US009624646B2

(12) United States Patent
Kuroda et al.

(10) Patent No.: US 9,624,646 B2
(45) Date of Patent: Apr. 18, 2017

(54) WORKING MACHINE AND METHOD FOR OPERATING WORKING MACHINE

(71) Applicant: KUBOTA CORPORATION, Osaka (JP)

(72) Inventors: Masahiro Kuroda, Osaka (JP); Ryosuke Kinugawa, Osaka (JP); Naohiro Saijo, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 14/489,947

(22) Filed: Sep. 18, 2014

(65) Prior Publication Data

US 2015/0132094 A1 May 14, 2015

(30) Foreign Application Priority Data

Nov. 13, 2013 (JP) ..... 2013-234949

(51) Int. Cl.
*E02F 9/22* (2006.01)
*E02F 9/20* (2006.01)
*E02F 3/34* (2006.01)

(52) U.S. Cl.
CPC ..... *E02F 9/2228* (2013.01); *E02F 3/3414* (2013.01); *E02F 9/2004* (2013.01); *E02F 9/2282* (2013.01); *E02F 9/2285* (2013.01)

(58) Field of Classification Search
USPC ..... 60/421, 486, 422; 701/50, 2, 99
See application file for complete search history.

(56) References Cited

U.S. PATENT DOCUMENTS 5,211,014 A * 5/1993 Kropp ..... E02F 9/2242 60/421
5,666,359 A * 9/1997 Bennett ..... H04L 12/44 370/358
6,062,331 A * 5/2000 Grunow ..... B60K 28/04 180/268
6,202,014 B1 3/2001 Brandt et al.
6,276,133 B1 * 8/2001 Yoshida ..... F15B 11/17 60/421
6,371,214 B1 * 4/2002 Anwar ..... E02F 3/434 172/1
6,785,596 B2 8/2004 Brandt et al.
7,142,967 B2 11/2006 Brandt et al.
(Continued)

*Primary Examiner* — Thomas Tarcza
*Assistant Examiner* — Richard Goldman
(74) *Attorney, Agent, or Firm* — Greenblum & Bernstein, P.L.C.

(57) ABSTRACT

A working machine includes: a first switch operable to set an operation amount; a second switch operable by being pressed; a control unit capable of detecting an operation of the first switch and an operation of the second switch, the control unit outputting a control signal based on the operation amount of the first switch and continuously outputting the control signal when the operation of the first switch is detected after detecting a release of the operation of the second switch under a state where the operation of the second switch is detected; an actuator configured to be activated by a hydraulic operation fluid; a solenoid valve capable of controlling, based on the control signal, a pilot pressure; and a control valve configured to supply, based on the pilot pressure, the hydraulic operation fluid to the actuator.

9 Claims, 6 Drawing Sheets

(56) References Cited

U.S. PATENT DOCUMENTS 7,518,333 B1 * 4/2009 Fisher ..... A01K 63/047 318/722
7,571,558 B2 * 8/2009 Horii ..... E02F 9/2239 37/348
7,743,611 B2 * 6/2010 Horii ..... E02F 9/2239 60/421
8,154,154 B2 * 4/2012 Buerer ..... G05B 19/0423 307/116
8,701,399 B2 * 4/2014 Horii ..... E02F 9/2239 60/421
2002/0153188 A1 * 10/2002 Brandt ..... B62D 7/1509 180/252
2002/0178624 A1 * 12/2002 Yamamoto ..... E02F 9/2004 37/348
2003/0089106 A1 * 5/2003 Ioku ..... E02F 9/2239 60/328
2004/0019414 A1 * 1/2004 Pillar ..... B60R 16/0315 701/2
2004/0100373 A1 * 5/2004 Ponziani ..... B60Q 1/40 340/476
2004/0123499 A1 * 7/2004 Arii ..... E02F 3/325 37/348
2005/0034915 A1 * 2/2005 Kumazawa ..... B66C 13/56 180/331
2005/0140207 A1 * 6/2005 Goebels ..... B60T 8/17616 303/140
2006/0065467 A1 * 3/2006 Schuh ..... B60K 17/10 180/305
2006/0236688 A1 * 10/2006 Ioku ..... E02F 9/2239 60/422
2009/0065340 A1 * 3/2009 Komori ..... H01H 27/007 200/337
2009/0293840 A1 * 12/2009 Nishi ..... F02D 31/001 123/350
2010/0071358 A1 * 3/2010 Ueda ..... E02F 9/2242 60/420
2010/0196096 A1 * 8/2010 Halonen ..... E01C 19/405 404/84.1
2012/0094801 A1 * 4/2012 Hyodo ..... E02F 9/2246 477/111
2013/0036729 A1 * 2/2013 Kinugawa ..... F16H 61/421 60/446
2013/0207587 A1 * 8/2013 Nesbitt ..... B60L 15/20 318/543
2014/0003900 A1 * 1/2014 Hyodo ..... G05G 9/047 414/685
2014/0058635 A1 * 2/2014 Furukawa ..... B60R 16/02 701/50
2015/0232000 A1 * 8/2015 Yasunobe ..... B60N 2/4606 297/411.32

* cited by examiner

WORKING MACHINE AND METHOD FOR OPERATING WORKING MACHINE

CROSS-REFERENCE TO RELATED APPLICATIONS

The present application claims priority under 35 U.S.C. §119 to Japanese Patent Application No. 2013-234949, filed Nov. 13, 2013. The contents of this application are incorporated herein by reference in their entirety.

BACKGROUND ART

Field of the Invention

The present invention relates to a working machine categorized as a vehicle type, for example, a skid steer loader, a compact truck loader and the like and relates to a method for operating the working machine.

Description of the Related Art

U.S. Pat. No. 6,062,331 and U.S. Pat. No. 7,142,967 disclose techniques as a control system for controlling a flow of a hydraulic operation fluid, the hydraulic operation fluid being contained in a hydraulic circuit relating to a working machine.

The control system disclosed in U.S. Pat. No. 6,062,331 includes: a first switch; a second switch; and a control device connecting to the first switch and the second switch. The first switch controls a flow direction of a fluid contained in an auxiliary hydraulic circuit, the auxiliary hydraulic circuit being configured to supply the hydraulic operation fluid to an auxiliary attachment and the like. The second switch outputs a signal, the signal indicating supply of a continuous flow to any one of a first direction and a second direction in the auxiliary hydraulic circuit, on the basis of the flow direction selected by the control of the first switch.

The control device outputs a signal to start the continuous flow in the auxiliary hydraulic circuit to any one of the first direction and the second direction when a controller receives: a signal corresponding to a state where the first switch is activated in order to guide the continuous flow to any one of the first direction and the second direction; a signal corresponding to a state where the second switch is activated in order to provide the continuous flow to a selected direction; and a signal corresponding to a state where the first switch is released within a predetermined period of time after the activation of the second switch.

In addition, the control system disclosed in U.S. Pat. No. 7,142,967 continuously supplies a hydraulic operation fluid to an actuator when the first switch and the second switch are pressed at the same time.

SUMMARY OF THE INVENTION

Problems to be Solved by the Invention

The control system disclosed in U.S. Pat. No. 6,062,331 cannot proceed to a continuous flow motion, the continuous flow motion being to continuously supply the hydraulic operation fluid to an actuator, without performing in sequence: a first manipulation that manipulates the first switch to move the auxiliary attachment; a second manipulation that manipulates the second switch; and a third manipulation that releases the first switch, thus a manipulation of the control system is complicated. In other words, the control system cannot be switched to a motion continuously supplying the hydraulic operation fluid to an actuator (the continuous flow motion) without performing the three steps of the manipulations. In particular, it is often difficult to perform the continuous flow motion immediately from a state where an attachment is at a standstill (a state where the hydraulic operation fluid is not supplied to the actuator).

In addition, without a simultaneous manipulation of the first switch and the second switch, the control system disclosed in U.S. Pat. No. 7,142,967 also cannot perform the continuous flow motion, thus it is often difficult to operate the control system.

Accordingly, considering the above-mentioned problems, it is an object of the present invention to provide a working machine and a method for operating the working machine, the working machine and the control method capable of easily performing the continuous flow motion continuously supplying the hydraulic operation fluid.

Means to Solve the Problems

To solve the above-mentioned technical problems, techniques that the present invention provides are characterized in the following points.

A working machine includes: a first switch operable to set an operation amount; a second switch operable by being pressed; a control unit configured to detect an operation of the first switch and an operation of the second switch, the control unit outputting a control signal based on the operation amount of the first switch, the control unit continuously outputting the control signal when the operation of the first switch is detected after detecting a release of the operation of the second switch under a state where the operation of the second switch is detected; an actuator configured to be activated by an operation fluid; a solenoid valve configured to control, based on the control signal, a pilot pressure; and a control valve configured to supply, based on the pilot pressure, the operation fluid to the actuator.

The working machine described above includes: a boom; and a auxiliary attachment configured to be attached to and detached from a tip end portion of the boom. The actuator is configured to operate the auxiliary attachment, the control valve includes an auxiliary control valve configured to supply, based on the pilot pressure, the operation fluid to the auxiliary attachment, and the second switch is configured to automatically return.

In the working machine described above, the control unit continuously outputs the control signal to the solenoid valve when the operation amount of the first switch reaches a maximum extent after detecting an operation of the first switch under a state where the release of the operation of the second switch is detected.

In the working machine described above, the control unit continuously outputs a control signal, the control signal being to maximize the pilot pressure, to the solenoid valve when the operation amount of the first switch reaches the maximum extent.

In the working machine described above, the control unit continuously outputs a control signal, the control signal being to maximize the pilot pressure, to the solenoid valve when an operation of the first switch is detected after detecting the release of the operation of the second switch.

The working machine described above further includes: an operation member configured to have the first switch and the second switch, the operation member being supported to be capable of freely swinging.

The working machine described above further includes: a first pump configured to discharge the operation fluid; and a second pump configured to discharge the pilot fluid. The control valve is connected to the first pump to receive the operation fluid, and the solenoid valve is connected to the second pump to receive the pilot fluid and is connected to the control unit to receive the control signal.

In the working machine described above, the control unit has: a continuous mode to continuously output the control signal; and a discontinuous mode to output the control signal when the first switch is operated.

A method for operating a working machine, the method includes: pressing a second switch operable by being pressed; releasing the pressing of the second switch; operating a first switch operable to set an operation amount; in operating the first switch, continuously outputting a control signal, based on the operation amount of the first switch, to a solenoid valve configured to control a pressure of a pilot fluid, the operation fluid being to activate an actuator; and controlling the pilot pressure acting to a control valve by changing an opening of the solenoid valve based on the continuously outputted control signal, the control valve supplying the operation fluid to the actuator.

The continuously outputting step includes in operating the first switch, continuously outputting the control signal to the solenoid valves when the operation amount corresponding to the operation of the first switch reaches a maximum extent.

The continuously outputting step includes in operating the first switch, continuously outputting a control signal, the control signal being to maximize the pilot pressure, to the solenoid valve when the operation amount corresponding to the operation of the first switch reaches a maximum extent.

The continuously outputting step includes in operating the first switch, continuously outputting a control signal, the control signal being to maximize the pilot pressure, to the solenoid valve.

A working machine includes: an operation member; a first switch provided to the operation member, the first switch being operable to set an operation amount; a second switch provided to the operation member, the second switch being operable by being pressed; a control unit configured to detect an operation of the first switch and an operation of the second switch, the control unit outputting a control signal based on the operation amount of the first switch, the control unit continuously outputting the control signal when the operation of the first switch is detected after detecting a release of the operation of the second switch under a state where the operation of the second switch is detected.

In the working machine described above, the control unit continuously outputs the control signal to the solenoid valve when the operation amount of the first switch reaches a maximum extent after detecting an operation of the first switch under a state where the release of the operation of the second switch is detected.

In the working machine described above, the control unit continuously outputs a control signal, the control signal being to maximize the pilot pressure, to the solenoid valve when the operation amount of the first switch reaches the maximum extent.

In the working machine described above, the control unit continuously outputs a control signal, the control signal being to maximize the pilot pressure, to the solenoid valve when an operation of the first switch is detected after detecting the release of the operation of the second switch.

Effects of the Invention

According to the present invention, the following effects are provided.

A continuous flow motion, the continuous flow motion continuously supplying a hydraulic operation fluid to an actuator, can be performed only by manipulating the first switch after serial actions of pressing the second switch (a press manipulation) and releasing the second switch (release of the press manipulation).

In addition, the second switch is a switch of an automatic return type, and accordingly the second switch necessarily takes the same position in continuously activating the actuator. In this manner, an operator can be made to recognize that the continuous activation of the actuator can be ready only by pressing the second switch.

Additionally, in a case where a manipulation amount of the first switch manipulated after the pressing and releasing of the second switch reaches a maximum extent, a control signal based on the manipulation amount is continuously outputted. Accordingly, the actuator can be continuously activated immediately only by manipulating the first switch to the maximum extent.

In addition, the actuator can be continuously activated at a maximum output power only by manipulating the first switch to the maximum extent.

Moreover, the actuator can be continuously activated at the maximum output power only by manipulating the first switch after the pressing and releasing of the second switch.

DETAILED DESCRIPTION OF THE INVENTION

Referring to drawings, an embodiment of the present invention will be described below.

Figure 2:
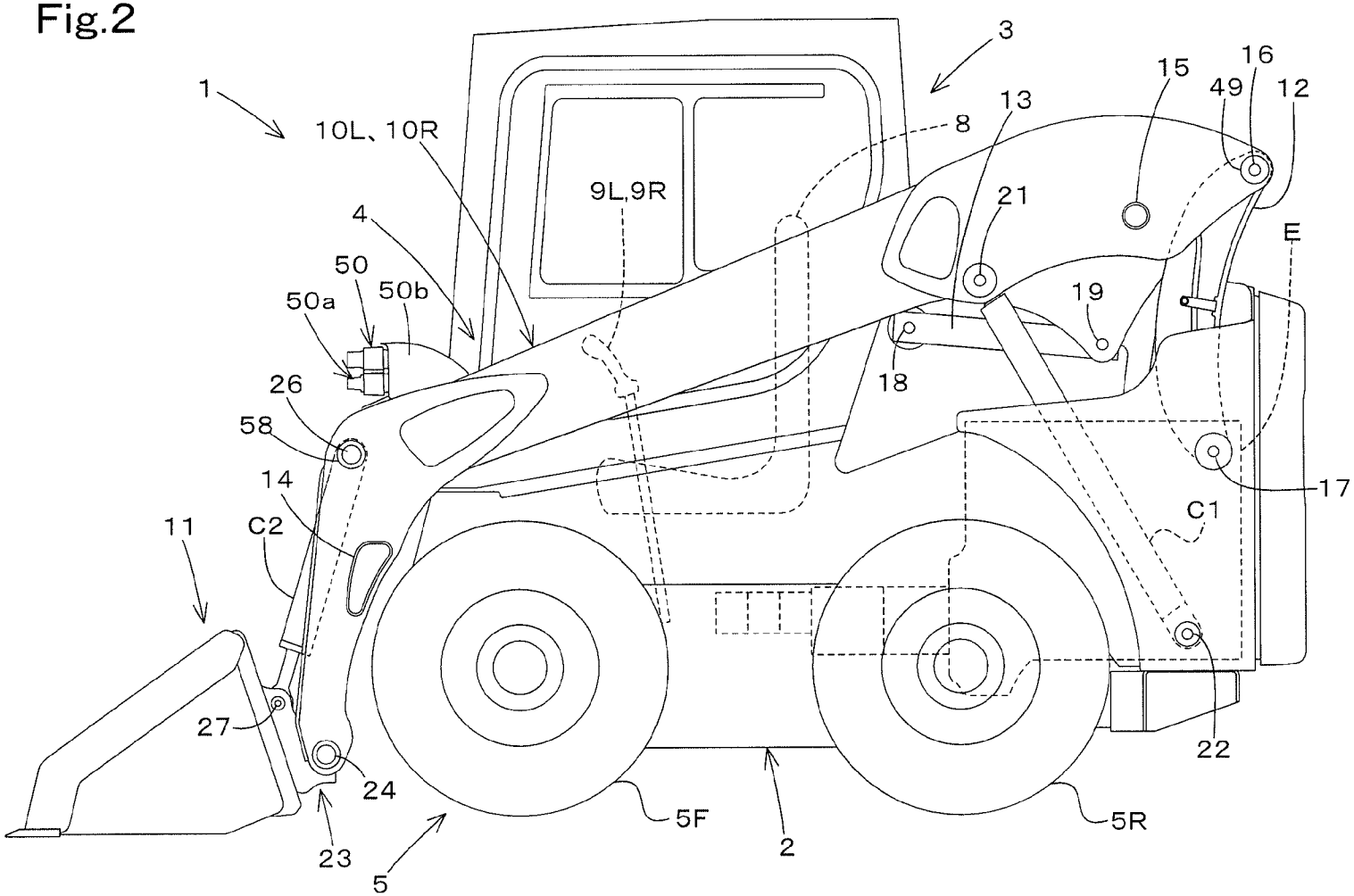
FIG. 2 is a side view of a skid steer loader.

FIG. 2 is an overall view showing a skid steer loader 1 exemplified as a working machine.

In the following description, an outward direction along aright to left direction (or along a left to right direction) is a direction toward an end portion in a right to left direction (or in a left to right direction) of the skid steer loader 1 from a center portion in the right to left direction (or in the left to right direction), hereinafter the direction being referred to as an "R to L outward". In addition, an inward direction along a right to left direction (or along a left to right direction) is a direction toward the center portion in the right to left direction (or in the left to right direction) of the skid steer loader 1 from the end portion in the right to left direction (or in the left to right direction), hereinafter the direction being referred to as an "R to L inward".

In FIG. 2, the skid steer loader 1 includes a machine frame 2, a cabin 3 mounted on the machine frame 2, an operation unit 4 installed on the machine frame 2, and a travel unit 5 provided to both of a right side and a left side of the machine frame 2.

An engine 7 is mounted on a rear portion on the machine frame 2. An operator seat 8 is provided to a rear portion in a room of the cabin 3. A pair of a left travel lever 9L (a travel lever 9L) and a right travel lever OR (a travel lever 9R) is provided in front of the operator seat 8, the left travel lever 9L and the right travel lever OR each being used for operation of the travel unit 5. The travel lever 9L provided to the left side of the operator seat 8 is a member used for operation of the travel unit 5 provided to the left side of the machine frame 2, and the travel lever OR provided to the right side of the operator seat 8 is a member used for operation of the travel unit 5 provided to the right side of the machine frame 2. Meanwhile, an operation member 25 is provided in the cabin 3, the operation member 25 being supported to be capable of freely swinging (rocking) and being used for operation of an auxiliary actuator 33 mentioned below (refer to FIG. 1).

The operation unit 4 has a right boom 10R (a boom 10R), a left boom 10L (a boom 10L), a bucket 11 (a work tool), a lift link 12, a control link 13, a boom cylinder C1, and a bucket cylinder C2. The right boom 10R is arranged on the right sides of the cabin 3 and the machine frame 2. And, the left boom 10L is arranged on the left sides of the cabin 3 and the machine frame 2. The bucket 11 is provided to tip sides (front end sides) of the right boom 10R and the left boom 10L, and is thereby capable of freely swinging upward and downward. The lift link 12 and the control link 13 support base portion sides (rear portion sides) of the booms 10R and 10L. The boom cylinder C1 lifts and lowers the booms 10L and 10R. The bucket cylinder C2 swings the bucket 11. The boom cylinder C1 and the bucket cylinder C2 are each composed of a double-acting hydraulic cylinder.

The tip sides of the right boom 10R and the left boom 10L are connected each other with a front connection member 14 formed of a deformed pipe. The base portion sides of the right boom 10R and the left boom 10L are connected each other with a rear connection member 15 formed of a circular pipe. The lift link 12, the control link 13, and the boom cylinder C1 are provided, corresponding to the right boom 10R and the left boom 10L, to each of the right side and the left side of the machine frame 2.

The lift links 12 are arranged approximately vertically at rear end sides (at the R to L outward of a rear end side of the machine frame 2) of the booms 10R and 10L. Upper end sides of the lift links 12 are pivotally supported via pivots 16 (hereinafter each referred to as a first pivot) by the rear end sides of the base portions of the booms 10R and 10L, thereby being freely rotatable centering around an axis extending along the right to left direction (or along the left to right direction). In addition, lower end sides of the lift links 12 are pivotally supported via pivots 17 (hereinafter each referred to as a second pivot) by an upper portion of the rear end side of the machine frame 2, thereby being freely rotatable centering around the axis extending along the right to left direction (or along the left to right direction).

The control links 13 are arranged along a front to rear direction in front of the lift links 12. Front end sides of the control links 13 are pivotally supported via pivots 18 (hereinafter each referred to as a third pivot) by the machine frame 2, thereby being freely rotatable centering around the axis extending along the right to left direction (or along the left to right direction). Rear end sides of the control links 13 are pivotally supported via pivots 19 (hereinafter each referred to as a fourth pivot) by lower end sides at an intermediate positions in the front to rear direction, the intermediate positions being closer to the base portion sides of the booms 10R and 10L than the tip sides, thereby being freely rotatable centering around the axis extending along the right to left direction (or along the left to right direction).

Upper portions of the boom cylinders C1 are pivotally supported via first boom cylinder pins 21 by front portions of the base portion sides of the booms 10R and 10L, thereby being freely rotatable centering around the axis extending along the right to left direction (or along the left to right direction). Lower portions of the boom cylinders C1 are pivotally supported via second boom cylinder pins 22 by a lower portion of the rear end side of the machine frame 2, thereby being freely rotatable centering around the axis extending along the right to left direction (or along the left to right direction). When the boom cylinders C1 are stretched and shortened, the tip sides (the bucket 11) of the booms 10R and 10L are lifted and lowered with the base portion sides of the booms 10R and 10L supported by the lift links 12 and the control links 13. In other words, the booms 10R and 10L swing upward and downward centering around the first pivots 16.

The control links 13 swing upward and downward centering around the third pivots 18 in synchronization with the upward and downward swinging of the booms 10R and 10L. The lift links 12 swing forward and backward centering around the second pivots 17 in synchronization with the upward and downward swinging of the control links 13.

The bucket 11 is attached to an attachment 23 in a freely attachable and detachable manner, the attachment 23 being pivotally supported by the tip sides (the front end sides) of the right boom 10R and the left boom 10L. The attachment 23 is pivotally supported via a pivotally-supporting pin 24 by the tip sides of the right boom 10R and the left boom 10L, thereby being capable of freely swinging centering around the axis extending along the right to left direction (or along the left to right direction). An attachment (an auxiliary attachment) such as a hydraulic crusher, a hydraulic breaker, an angle broom, an earth auger, a pallet fork, a sweeper, a mower, and a snow blower can be attached to the attachment 23 instead of the bucket 11.

The bucket cylinders C2 are respectively arranged on the R to L inward of the tip sides of the right boom 10R and the left boom 10L. Upper end sides of the bucket cylinders C2 are pivotally supported via first bucket cylinder pins 26 by the booms 10R and 10L, thereby being freely rotatable centering around the axis extending along the right to left direction (or along the left to right direction). Lower end sides of the bucket cylinders C2 are pivotally supported via second bucket cylinder pins 27 by the attachment 23, thereby being freely rotatable centering around the axis extending along the right to left direction (or along the left to right direction). When the bucket cylinders C2 are stretched and shortened, the bucket 11 is swung by the stretching and shortening.

In the embodiment, each of the travel units 5 provided to the right side and the left side employs a wheel type travel unit 5 having a front wheel 5F and a rear wheel 5R. Meanwhile, the travel units 5 may employ a travel unit of a crawler type (including a semi-crawler type).

Figure 1:
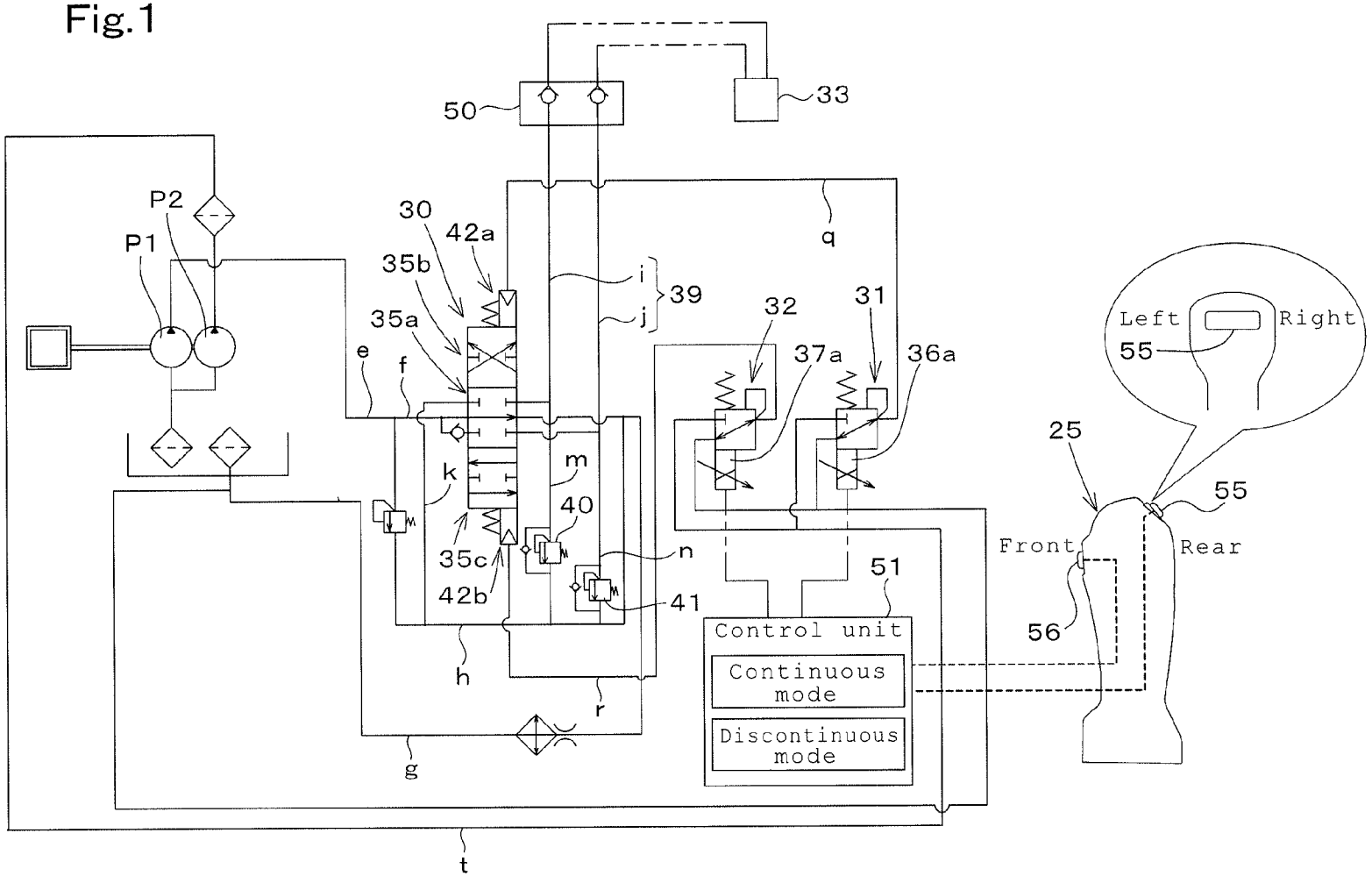
FIG. 1 is a diagram showing a hydraulic circuit for an operation system.

FIG. 1 shows a hydraulic circuit to operate the auxiliary attachment.

At first, an overall configuration of the hydraulic circuit will be explained below.

As shown in FIG. 1, the hydraulic circuit has a first pump P1, a second pump P2, an auxiliary control valve (referred to as an SP control valve) 30, and a pair of auxiliary solenoid valves (referred to as SP solenoid valves) 31 and 32 operating the SP control valve 30.

The first pump P1 is constituted of a gear pump of a constant displacement type, the gear pump being driven by a motive power of the engine 7. The first pump P1 is used for driving the hydraulic actuator 33 of the auxiliary attachment to be attached instead of the bucket 11. To simplify the explanation, the hydraulic actuator 33 of the auxiliary attachment is referred to as an auxiliary actuator.

The SP control valve 30 is constituted of a 3-position selector valve of a direct-acting spool type, the 3-position selector valve working in a hydraulic pilot system. The SP control valve 30 is freely switched between a neutral position 35*a*, a first position 35*b*, and a second position 35*c* by a pilot pressure. Additionally, the SP control valve 30 is configured to be returned to the neutral position 35*a* with use of a spring.

A work system fluid supply path f is connected to the SP control valve 30, the work system fluid supply path f being communicated with a discharge path e of the first pump P1. In addition, a bypass fluid path h is connected to the SP control valve 30 via an exhaust fluid path k, and a drain fluid path g is also connected to the SP control valve 30, the drain fluid path g returning to a tank side. Moreover, a hydraulic operation fluid supply path 39 is provided between the SP control valve 30 and a connection unit 50 to connect the SP control valve 30 and the connection unit 50 to each other. The hydraulic operation fluid supply path 39 is constituted of two flow paths. One of the two flow paths, a flow path i, is connected to the bypass fluid path h via a first relief path m, and the other one of the two flow paths, a flow path j, is connected to the bypass fluid path h via a second relief path n. The first relief path m and the second relief path n are respectively provided with a relief valve 40 and a relief valve 41.

The connection unit 50 is a member to connect the SP control valve 30 to the auxiliary actuator 33. The connection unit 50 connects the SP control valve 30 to the auxiliary actuator 33 via the hydraulic operation fluid supply path 39, a hydraulic hose, and the like. More particularly, as shown in FIG. 1 and FIG. 2, the connection unit 50 is constituted of: a hydraulic coupler 50*a* provided to a front side of the left boom 10L; and a support member (an installation stay) 50*b* supporting the hydraulic coupler 50*a* on the left boom 10L.

One of the SP solenoid valves, the SP solenoid valve 31, is connected to a pressure reception part 42*a* via a first pilot fluid path q, the pressure reception part 42*a* being provided on one end side of the SP control valve 30. The other one of the SP solenoid valves, the SP solenoid valve 32, is connected to a pressure reception part 42*b* via a second pilot fluid path r, the pressure reception part 42*b* being provided on the other end side of the SP control valve 30. A pilot fluid (a pressure fluid) can be supplied from the second pump P2 to the SP solenoid valves 31 and 32 via a pilot pressure fluid supply path t.

Accordingly, when the SP solenoid valve 31 switches the SP control valve 30 to the first position 35*b*, an operation fluid (for example, a hydraulic operation fluid, a hydraulic operation oil and the like) from the first pump P1 is supplied from one of the flow paths, the flow path i, to the auxiliary actuator 33, and a fluid returning from the auxiliary actuator 33 flows from the other one of the flow paths, the flow path j, to the exhaust fluid path k.

In addition, when the SP solenoid valve 32 switches the SP control valve 30 to the second position 35*c*, the hydraulic operation fluid from the first pump P1 is supplied from the other one of the flow paths, the flow path j, to the auxiliary actuator 33, and the fluid returning from the auxiliary actuator 33 flows from the first hydraulic operation fluid flow path i to the exhaust fluid path k.

The above-mentioned hydraulic circuit is capable of operating the SP solenoid valves 31 and 32 to activate the auxiliary actuator 33 of an auxiliary attachment via the SP control valve 30.

The control of the SP solenoid valves 31 and 32 is performed by a control unit 51 mounted on the working machine 1 (the skid steer loader 1). The control unit 51 performs the operation of the SP solenoid valves 31 and 32 (the SP control valve 30) in accordance with manipulations (operations) of switches and the like provided to the operation member 25.

Particularly, a head portion of the operation member 25 is provided with a first switch 55 and a second switch 56. The first switch 55 and the second switch 56 are connected to the control unit 51. The first switch 55 and the second switch 56 are opposed to each other. For example, the first switch 55 is provided on a back surface of the operation member 25, and the second switch 56 is provided on a front surface of the operation member 25, the front surface being opposed to the back surface.

The first switch 55 is a switch capable of freely swinging (rocking) to both of a right direction (the right side) and a left direction (the left side), a displacement from a neutral state (for example, a swing (rock) angle of the first switch 55) is employed as an operation amount. When the first switch 55 is swung (rocked) to one side (for example, to the left side), a swing (rock) angle to one direction is inputted to the control unit 51 as the operation amount. In addition, when the first switch 55 is swung (rocked) to the other side (for example, to the right side), a swing (rock) angle to the other direction is inputted to the control unit 51 as the operation amount. In the following explanation, the operation amount corresponding to the swinging (rocking) to the left side of the first switch 55 is referred to as a "left operation amount", and the operation amount corresponding to the swinging (rocking) to the right side of the first switch 55 is referred to as a "right operation amount".

The second switch 56 is a switch of a push type (a press type), particularly the second switch 56 is a push switch of an automatic return type, the automatic return type automatically returning the switch to an initial position after being pushed (pressed). When the second switch 56 is pushed (pressed), a signal (an ON signal) indicating a state where the switch 56 is pushed (pressed) is inputted to the control unit 51. When the second switch 56 automatically returns to the initial position, a signal (an OFF signal) indicating a state where the push (the press) is released is inputted to the control unit 51.

Meanwhile, the control unit 51 has a continuous mode (a continuous flow mode) and a discontinuous mode (a discontinuous flow mode). The continuous mode is a mode to continuously supply the hydraulic operation fluid to the auxiliary actuator 33. The discontinuous mode is a mode to supply the hydraulic operation fluid to the auxiliary actuator 33 only in a period when the first switch 55 is manipulated.

When the left operation amount is inputted by the manipulation (the operation) of the first switch 55, the control unit 51 set to the discontinuous mode outputs a control signal depending on the left operation amount to one of the SP solenoid valves, the SP solenoid valve 31, to magnetize a solenoid 36*a* of the SP solenoid valve 31.

In this manner, a pilot pressure proportional to the left operation amount of the first switch 55 is outputted from one of the SP solenoid valves, the SP solenoid valve 31. The outputted pilot pressure acts to the pressure reception part 42*a* via the first pilot fluid path q, the pressure reception part 42*a* being provided on one end side of the SP control valve 30. Then, the SP control valve 30 is operated to the first position 35*b* in proportion to the left operation amount of the first switch 55.

When the right operation amount is inputted by the manipulation (the operation) of the first switch 55, the control unit 51 set to the discontinuous mode outputs a control signal depending on the right operation amount to the other one of the SP solenoid valves, the SP solenoid valve 32, to magnetize a solenoid 37*a* of the SP solenoid valve 32.

In this manner, a pilot pressure proportional to the right operation amount of the first switch 55 is outputted from the other one of the SP solenoid valves, the SP solenoid valve 32. The outputted pilot pressure acts to the pressure reception part 42*b* via the second pilot fluid path r, the pressure reception part 42*b* being provided on the other end side of the SP control valve 30. Then, the SP control valve 30 is operated to the second position 35*c* in proportion to the right operation amount of the first switch 55.

Accordingly, when the control unit 51 is set to the discontinuous mode, the control unit 51 is capable of supplying, depending on the manipulation of the first switch 55, the hydraulic operation fluid to the auxiliary actuator 33 in one direction and supplying, depending on the manipulation of the first switch 55, the hydraulic operation fluid to the auxiliary actuator 33 in the other direction.

When after a push manipulation (a push operation) of the second switch 56 is performed (the second switch 56 is pressed) under a state where the control unit 51 is in the discontinuous mode, the first switch 55 is manipulated (is swung (rocked) to one direction or the other direction) further after the push manipulation of the second switch 56 is released (the pressing of the second switch 56 is terminated), the control unit 51 is switched from the discontinuous mode to the continuous mode.

Specifically, when under the state where the control unit 51 is in the discontinuous mode, the control unit 51 detects that the second switch 56 is pushed (pressed) (detection of the ON signal), detects that the second switch 56 is released (detection of the OFF signal), and further detects that the first switch 55 is manipulated (detection of the displacement from the neutral state), the control unit 51 is switched to the continuous mode.

Meanwhile, the control unit 51 is set to the discontinuous mode under a default state (for example, at a time of electric power supply and at a time of start-up), and is switched to the continuous mode only after the above-mentioned manipulations are performed.

The control unit 51 retains the operation amount of the first switch 55 when a predetermined time passes after the control unit 51 has been switched to the continuous mode. After that, the control unit 51 outputs a control signal, the control signal corresponding to the retained operation amount, to the solenoid 36*a* of the SP solenoid valve 31 or to the solenoid 37*a* of the SP solenoid valve 32.

For example, when the first switch 55 is swung (rocked) to a maximum area (or to a maximum extent) after the pushing (pressing) of the second switch 56, the control unit 51 retains the operation amount of the first switch 55 manipulated to the maximum area and outputs the control signal depending on the operation amount. In the embodiment, expressing a swing area (a rock area) in percentage (0 to 100%), the swing area corresponding to a position of the first switch 55 swung from a neutral position (corresponding to the neutral state) to a maximum position (corresponding to the maximum extent), the swing area expressed in 80% to 100% is employed as the maximum area. Specifically, in expressing the swing area in percentage, the neutral position is expressed in "0%" and the maximum position is expressed in "100%". More specifically, considering: the operation amount of the first switch 55 positioned at the neutral position as "0"; and the operation amount of the first switch 55 positioned at the maximum position by being swung from the neutral position to the one direction or the other direction at the maximum as "100", the control unit 51 retains the operation amount falling within a range of "80 to 100" and continuously outputs the control signal corresponding to the retained operation amount.

Meanwhile, under the state where the control unit 51 is in the continuous mode, the continuous mode may be released by performing again the push manipulation of the second switch 56. And, under a state where the auxiliary actuator 33 is activated in the continuous mode, the continuous mode may be released by performing again the operation of the first switch 55. As described above, various methods may be employed as a method to release the continuous mode.

In addition, the solenoid valves 31 and 32 may be controlled to output a predetermined pilot pressure (a regulated pilot pressure) when the operation amount of the first switch 55 reaches the maximum area. The regulated pilot pressure may be a pilot pressure arbitrarily determined, and may be a maximum pilot pressure (a pilot pressure that maximizes a flow amount of the hydraulic operation fluid to be supplied to the auxiliary actuator 33). In other words, the control unit 51 continuously outputs a control signal, the control signal maximizing the pilot pressure, to the solenoid valves 31 and 32 after the operation amount of the first switch 55 reaches the maximum area. In this manner, it is not necessary to hold the first switch 55 for a predetermined time but necessary to manipulate the first switch 55 to the maximum area within a predetermined time, and thereby simplifying the manipulation.

In the present invention, the continuous flow motion to supply the hydraulic operation fluid to the actuator can be performed only by manipulating the first switch 55 after the pressing and releasing of the second switch 56. For example, in a case where it is required to continuously move the breaker attached to the tip ends of the booms 10R and 10L, the breaker can be continuously moved only by swinging (rocking) the first switch 55 (swinging the first switch 55 to the maximum area) after pressing and releasing the second switch 56 at a timing to continuously move the breaker. That is, under a state where the control unit 51 is set in the continuous mode to move the breaker, the breaker can be automatically moved without manipulating the first switch 55.

In particular, a timing to continuously move the breaker can be arbitrarily determined. That is, the breaker can be continuously moved immediately after beginning of the working. For example, when the first switch 55 is manipulated after the pressing and the releasing of the second switch 56 under a state where a motion of the breaker stops, the breaker can be immediately moved continuously.

In addition to this, the second switch 56 is the switch of the automatic return type, and accordingly the second switch 56 is necessarily in the same position in continuously activating the actuator. Accordingly, an operator can be made to recognize that the continuous activation of the actuator can be ready only by pressing the second switch 56.

In addition, at a timing when the operation amount of the first switch 55 reaches the maximum area after the pressing and the releasing of the second switch 56, the control unit 51 continuously outputs the control signal based on the operation amount to the solenoid valves 31 and 32. In this manner, the actuator can be continuously activated immediately only by manipulating the first switch 55 to the maximum area.

Moreover, the control unit 51 continuously outputs the control signal to maximize the pilot pressure to the solenoid valves 31 and 32 after the operation amount of the first switch 55 reaches the maximum area. Accordingly, the actuator can be continuously activated at a maximum output power only by manipulating the first switch 55 to the maximum area.

Note that all the descriptions disclosed in the embodiment are examples and accordingly do not restrict a scope of the present invention. The scope of the present invention is represented not by the description of the embodiment but by the claims, and intends to include: equivalents of the claims; and all modifications within the scope of the present invention.

In the above-described embodiment, the continuous mode is set when: the ON signal of the second switch 56 is detected (a first condition); the OFF signal of the second switch 56 is detected (a second condition); and the first switch 55 is swung (rocked) (a third condition). However, in addition to these conditions, the continuous mode may be set when the swinging (rocking) of the first switch 55 is released (a fourth condition). Specifically, in addition to the first condition to the third condition, the continuous mode may be set in a case of detecting the returning of the first switch 55 to the neutral state. Furthermore, it is preferable that the pilot pressure is set to the above-mentioned regulated pilot pressure in the case where the continuous mode is set in the above-mentioned manner.

In the above-described embodiment, when the operation amount of the first switch 55 reaches the maximum area under the state where the control unit 51 is in the continuous mode, the pilot pressure is set to be the highest pilot pressure (the maximum pilot pressure). However, instead of the manner, the pilot pressure may be set to be the maximum pilot pressure only by manipulating the first switch 55 even when the operation amount of the first switch 55 does not reach the maximum area. Specifically, when the control unit 51 detects the manipulation of the first switch 55 after detecting the releasing of the press manipulation of the second switch 56, the control unit 51 may continuously output the control signal to maximize the pilot pressure to the solenoid valves 31 and 32. In this manner, the actuator can be continuously activated at the maximum output power only by manipulating the first switch 55 after the pressing and the releasing of the second switch 56.

Figure 3A:
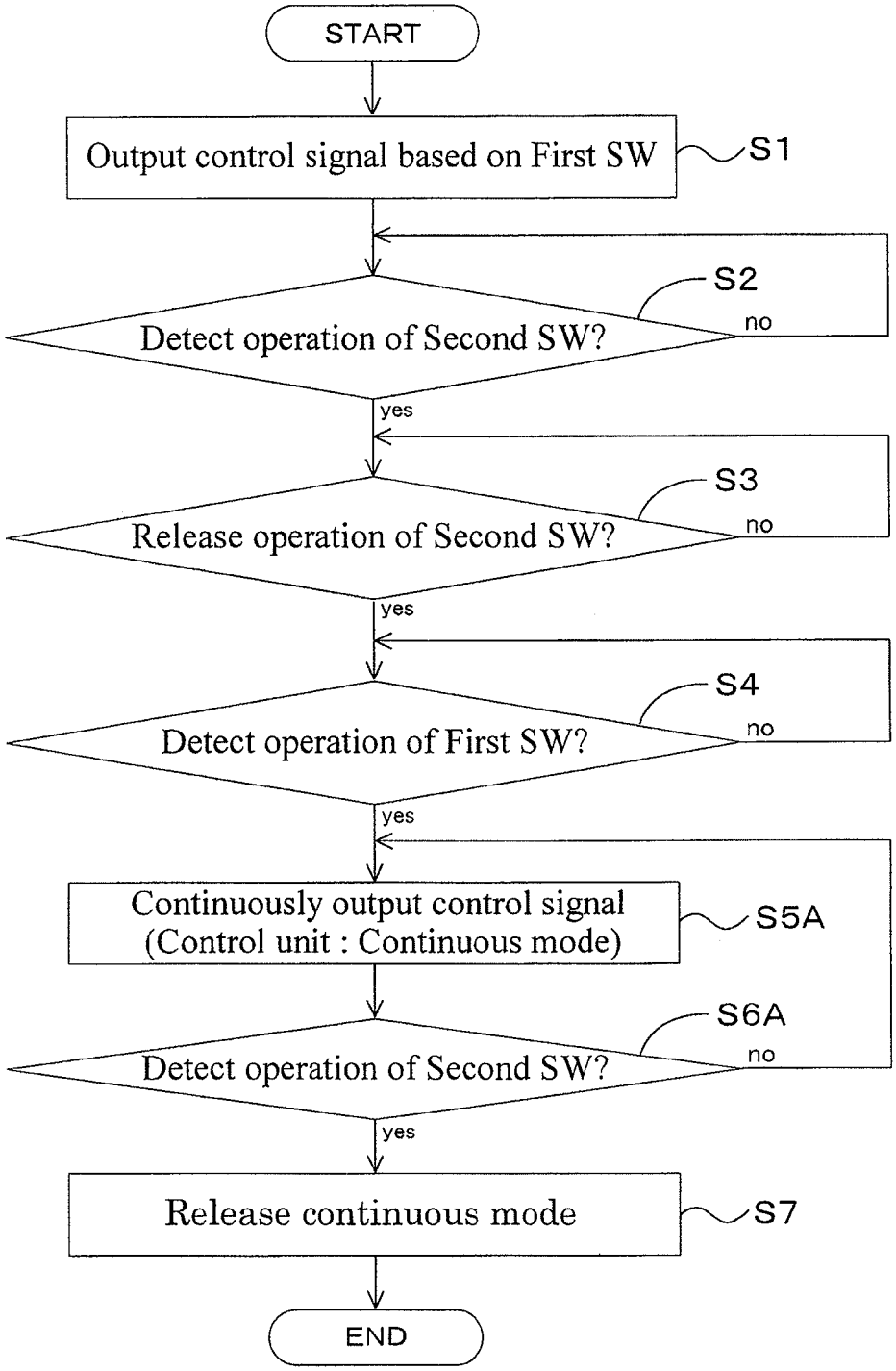
FIG. 3A shows a first flowchart showing a relationship between an operation of a first switch, an operation of a second switch, and a continuous mode.
Figure 3B:
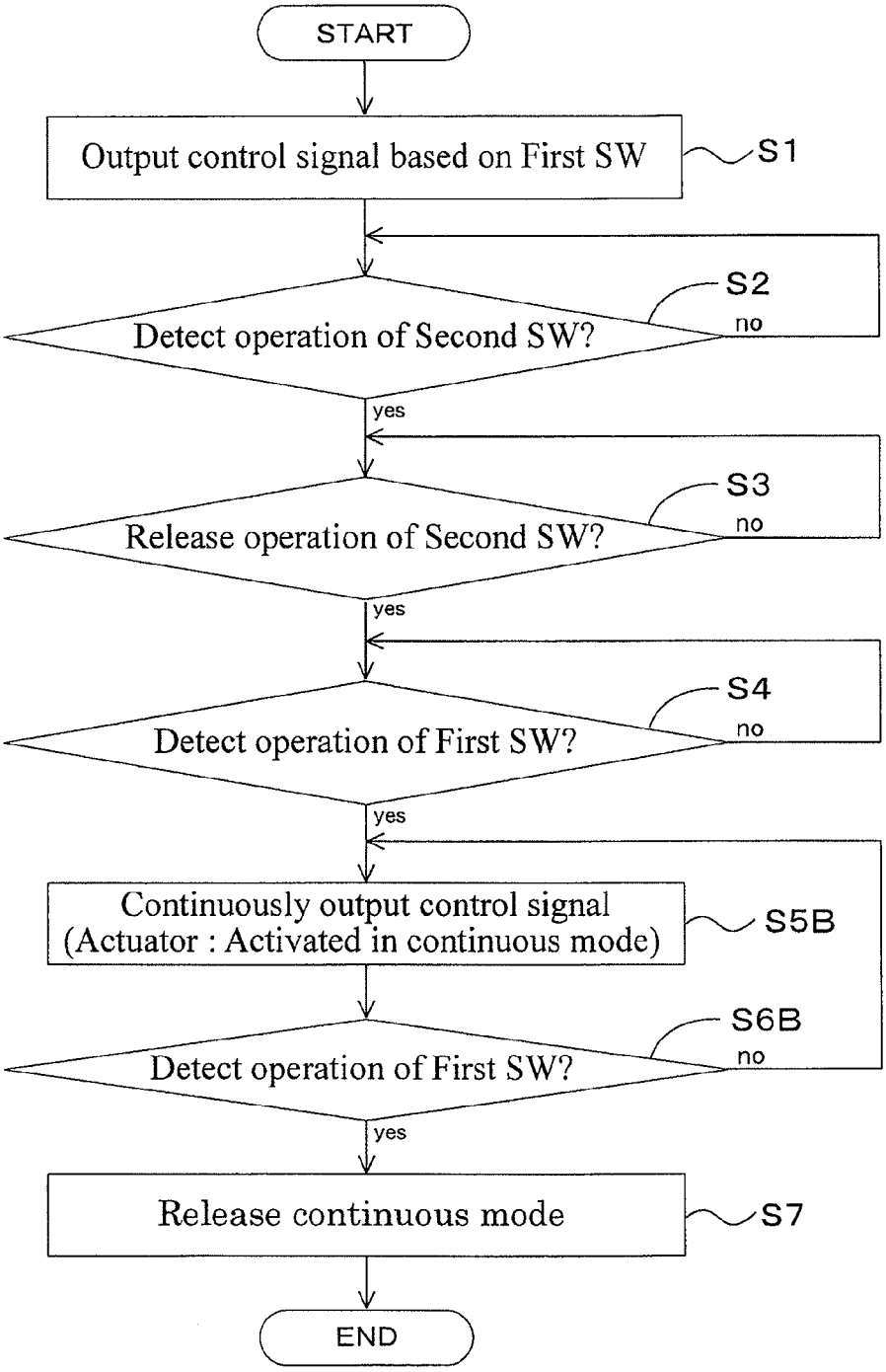
FIG. 3B shows a second flowchart showing a relationship between the operation of the first switch, the operation of the second switch, and the continuous mode.
Figure 4A:
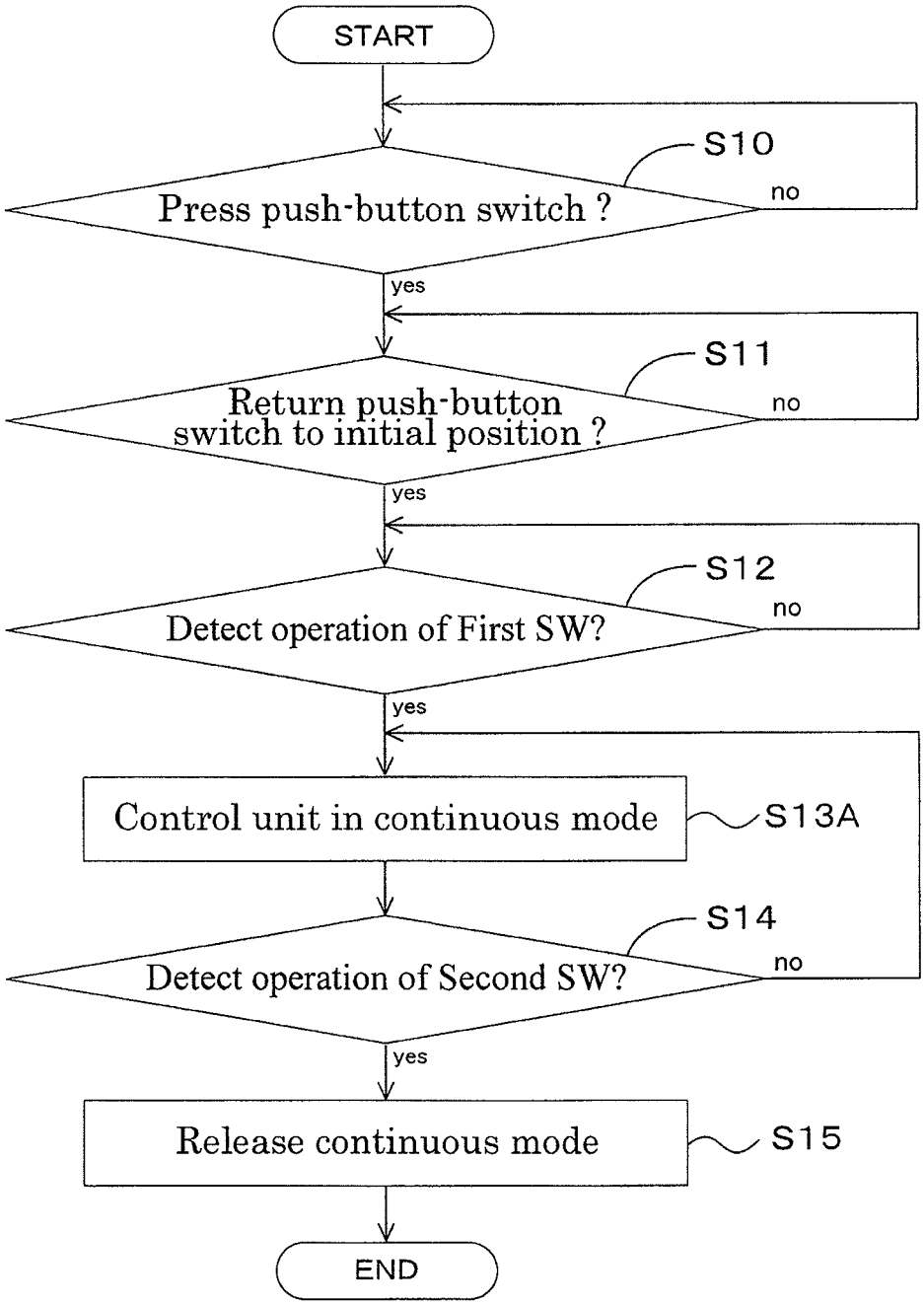
FIG. 4A shows a third flowchart showing a relationship between an operation of a push-button switch, the operation of the first switch, the operation of the second switch, and the continuous mode.
Figure 4B:
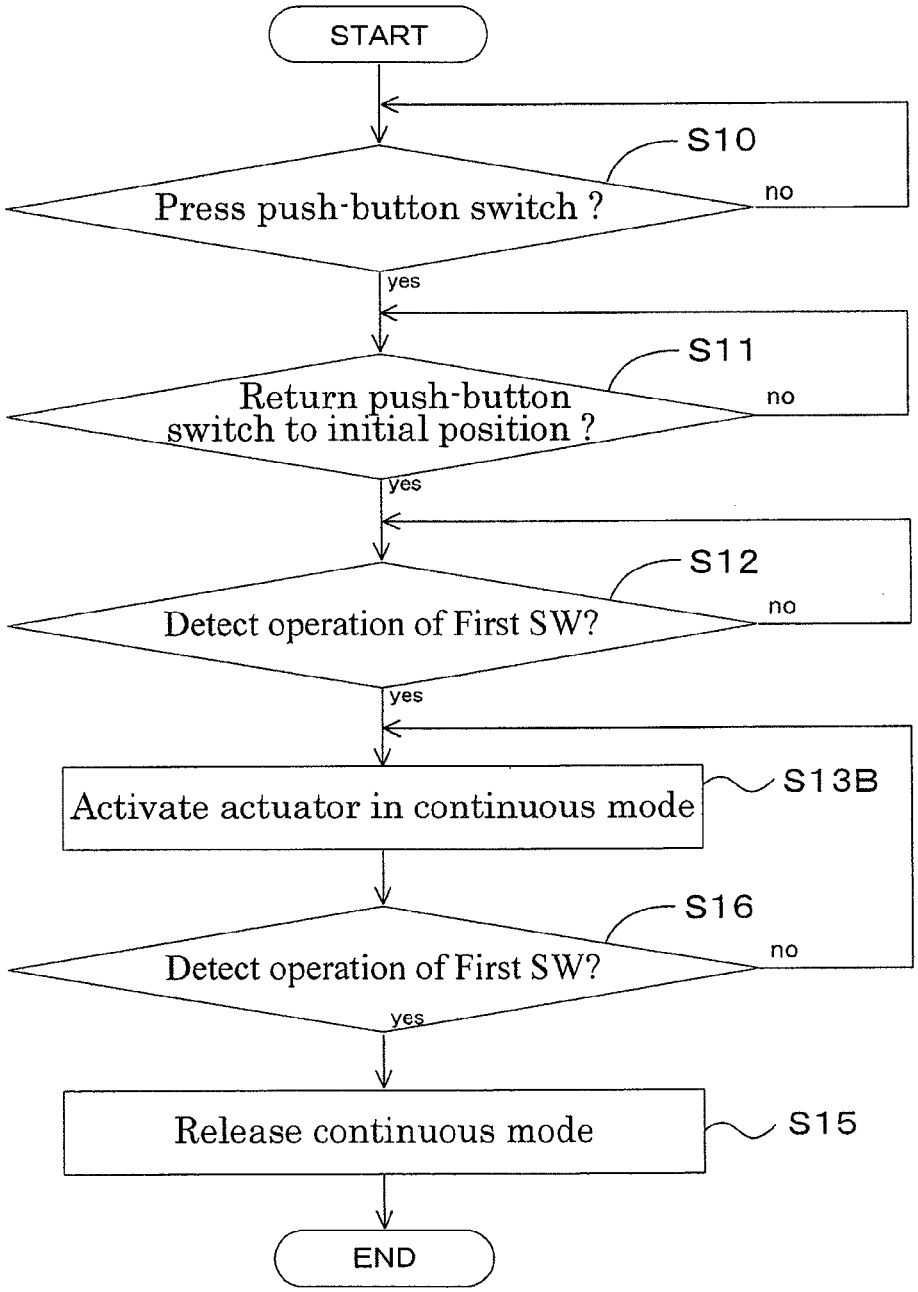
FIG. 4B shows a fourth flowchart showing a relationship between the operation of the push-button switch, the operation of the first switch, and the continuous mode.

FIG. 3A is a first flowchart showing a relationship between an operation of a first switch, an operation of a second switch, and a continuous mode. FIG. 3B is a second flowchart showing a relationship between the operation of the first switch, the operation of the second switch, and the continuous mode. FIG. 4A is a third flowchart showing a relationship between an operation of a push-button switch, the operation of the first switch, the operation of the second switch, and the continuous mode. Finally, FIG. 4B is a fourth flowchart showing a relationship between the operation of the push-button switch, the operation of the first switch, and the continuous mode.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A working machine comprising:

a machine frame;

a cabin disposed on the machine frame;

a boom disposed on a side of the cabin;

an auxiliary attachment configured to be attached to and detached from a tip end portion of the boom;

an actuator configured to be activated by an operation fluid and to activate the auxiliary attachment;

a solenoid valve having a solenoid and being configured to control, based on a control signal outputted to the solenoid, a pilot pressure being a pressure of a pilot fluid different from the operation fluid;

an auxiliary control valve configured to supply, based on the pilot pressure controlled by the solenoid valve, the operation fluid to the actuator;

an operation member having a head portion;

a first switch being disposed on the head portion of the operation member and being operable to set an operation amount;

a second switch being disposed on the head portion of the operation member and being operable by being pressed, the second switch being configured to automatically return to an initial position; and a control unit configured to detect an operation of the first switch and an operation of the second switch, the control unit further being configured to:

output a control signal based on the operation amount of the first switch, continuously output the control signal to the solenoid of the solenoid valve when the operation of the first switch is detected after detecting a release of the operation of the second switch under a state where the operation of the second switch is detected, and release a continuous mode by further performing the operation of the second switch under a state where the control unit is in the continuous mode or to release the continuous mode by further performing the operation of the first switch under a state where the actuator is activated in the continuous mode.

2. The working machine according to claim 1, wherein the control unit continuously outputs the control signal to the solenoid valve when the operation amount of the first switch reaches a maximum extent after detecting an operation of the first switch under a state where the release of the operation of the second switch is detected.

3. The working machine according to claim 2, wherein the control unit continuously outputs a control signal, the control signal being to maximize the pilot pressure to the solenoid valve when the operation amount of the first switch reaches the maximum extent.

4. The working machine according to claim 1, wherein the control unit continuously outputs a control signal, the control signal being to maximize the pilot pressure, to the solenoid valve when an operation of the first switch is detected after detecting the release of the operation of the second switch.

5. The working machine according to claim 1, further comprising:

a first pump configured to discharge the operation fluid;

a second pump configured to discharge the pilot fluid;

a discharge path configured to connect the auxiliary control valve and the first pump to each other to enable the auxiliary control valve to receive the operation fluid;

a pilot fluid path configured to connect the solenoid valve and the second pump to each other to enable the solenoid valve to receive the pilot fluid;

a connection unit disposed on the boom and configured to be connected to a hydraulic hose connected to the actuator; and a hydraulic operation fluid supply path configured to connect the connection unit and the auxiliary control valve.

6. The working machine according to claim 1, wherein the control unit has:

the continuous mode to continuously output the control signal; and a discontinuous mode to output the control signal when the first switch is operated.

7. The working machine according to claim 1, wherein the second switch is disposed opposed to the first switch on the head portion of the operation member.

8. A working machine comprising:

a machine frame;

a cabin disposed on the machine frame;

at least one boom disposed on a side of the cabin;

an auxiliary attachment configured to be attached to and detached from an attachment portion of the boom;

an actuator configured to be activated by an operation fluid and to activate the auxiliary attachment;

a solenoid valve having a solenoid and being configured to control, based on a control signal outputted to the solenoid, a pilot pressure;

an auxiliary control valve configured to supply, based on the pilot pressure controlled by the solenoid valve, the operation fluid to the actuator;

an operation handle;

a first switch disposed on the operation handle and being a rocker switch or a three-position switch;

a push-button switch being disposed on the operation handle and being configured to automatically return to an initial position when not pressed; and a control unit connected to the first switch and to the push-button switch and being configured to change operation between a discontinuous mode and a continuous mode, wherein, when the continuous mode is activated, the control unit continuously outputs the control signal to the solenoid of the solenoid valve, wherein the continuous mode is activated when:

the push-button switch is pressed;

then, the push-button switch returns an initial position; and then, activation of the first switch is detected, and wherein the continuous mode is released when:

the operation of the push-button switch is further performed under a state where the control unit is in the continuous mode; or the operation of the first switch is further performed under a state where the actuator is activated in the continuous mode.

9. The working machine according to claim 8, wherein the discontinuous mode is a default mode.

* * * * *